US006363830B1

(12) United States Patent
Gonzalez

(10) Patent No.: US 6,363,830 B1
(45) Date of Patent: Apr. 2, 2002

(54) DOOR STRUCTURE FOR MINE PROTECTION

(75) Inventor: René G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/519,230

(22) Filed: Mar. 6, 2000

(51) Int. Cl.[7] ..... F41H 5/00
(52) U.S. Cl. ..... 89/36.01; 89/36.08
(58) Field of Search ..... 89/36.01, 36.08, 89/36.07; 102/302

(56) References Cited

U.S. PATENT DOCUMENTS 3,983,832 A * 10/1976 Kinder ..... 115/1
4,326,445 A * 4/1982 Bemiss ..... 89/36
5,340,189 A * 8/1994 Goodman ..... 296/152
5,663,520 A * 9/1997 Ladika et al. ..... 89/36.08
D440,907 S * 4/2001 De Wet ..... D12/12

* cited by examiner

*Primary Examiner*—Charles T. Jordan
*Assistant Examiner*—M Thomson
(74) *Attorney, Agent, or Firm*—David L. Kuhn; Gail S. Soderling; Clifford Clay Carter

(57) ABSTRACT

An improved blast shield for use on a wheeled military vehicle. The blast shield has at least a portion responsive to a blast under the vehicle that reacts in response to the blast to block the door of the passenger compartment whereby the occupants of the compartment are protected from ejection from the vehicle for the duration of the blast effect.

3 Claims, 3 Drawing Sheets

DOOR STRUCTURE FOR MINE PROTECTION

GOVERNMENT INTEREST

The invention described here may be made, used and licensed by the United States Government for governmental purposes without paying me any royalty.

BACKGROUND OF THE INVENTION

1. Field of the Invention

In one aspect this invention relates to vehicle structures. In a further aspect this invention relates to military vehicles having blast protection devices.

2. Prior Art

When a ground vehicle passes over a land mine, the blast creates a large dynamic load on the vehicle structure which in turn frequently causes the vehicle latches to fail and the doors to fly open. Once the doors are open, the occupants can be easily stuck by blast forces, blast debris and possibly be ejected from the vehicle causing injury. Since land mines are relatively cheap, they have become ubiquitous in many parts of the world. Therefore, land mine encounters are becoming increasingly common as military troops take on peace keeping and other quasi-military missions in many parts of the world where they operate wheeled vehicles in unfamiliar and dangerous terrain. This has resulted in many injuries even where the vehicle has a blast shield disposed underneath the cab that will prevent the blast from collapsing the cab protecting the vehicle cab and preventing debris and shrapnel from entering the cab.

Present, solutions to the problem of sudden door opening due to blasts, consist of positive latching mechanisms such as sliding bolt type closures. Such closures have major disadvantages in that they require positive action to latch with the result that human error can result in the latch not being used. This is particularly true when the vehicle is being used under hostile conditions where speed is essential and the vehicle occupants are under stress. Further once latched, the doors require a positive operation to unlatch. This could create a safety condition should it be necessary to exit the vehicle rapidly; particularly if the latch has been jammed or there is some sort of misalignment as a result of a blast.

What is needed is a safety mechanism that deploys automatically to prevent unwanted door opening when needed to keep the doors closed and which does not interfere with the door's normal operation under normal conditions.

SUMMARY OF THE INVENTION

Briefly, the present invention comprises an improved blast shield protecting the passenger compartment of a wheeled military vehicle from land mine blast, the blast shield being adapted to interact with the doors to the compartment. The vehicle has a compartment for use by personnel, the compartment having a door hinged to the compartment that has a swing path that opens outward with respect to the compartment for ingress and egress. The ballistic blast shield is located on the under side of the vehicle and serves to protect the vehicle occupants in the event of a land mine detonation if the vehicle passes over a land mine. The improved blast shield of this invention has a reactive portion that responds to the force of a mine blast to move from a first ready position near the bottom edge of the door to a second blocking position. When the reactive portion is in the first ready position the door can be easily opened. When the reactive portion has moved to its second blocking position, it will prevent the door's movement along the swing path and retain the door in a closed position as long as there is a significant blast effect acting on the shield. The blocking action will protect the occupants from being ejected from the vehicle for the duration of the blast effect and keep the door closed to prevent debris from entering the passenger compartment. Depending upon blast force, the reactive portion may return to an unblocking position. Combat vehicles are also made with a roof exit so any crew and passengers can always exit even if the doors remain blocked.

DETAILED DESCRIPTION

Figure 1:
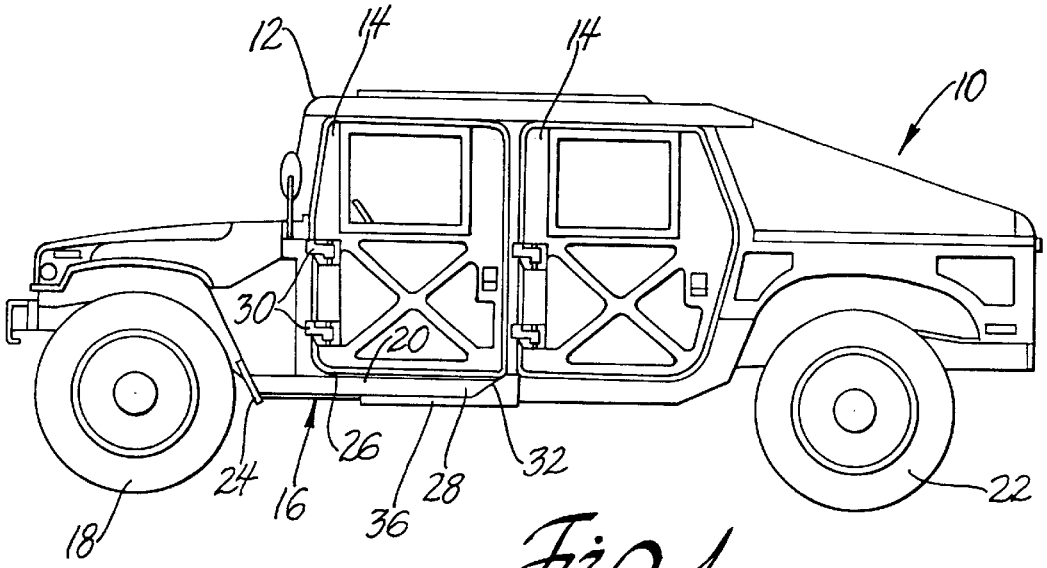
FIG. 1 is a side view of one embodiment before a mine blast.
Figure 2:
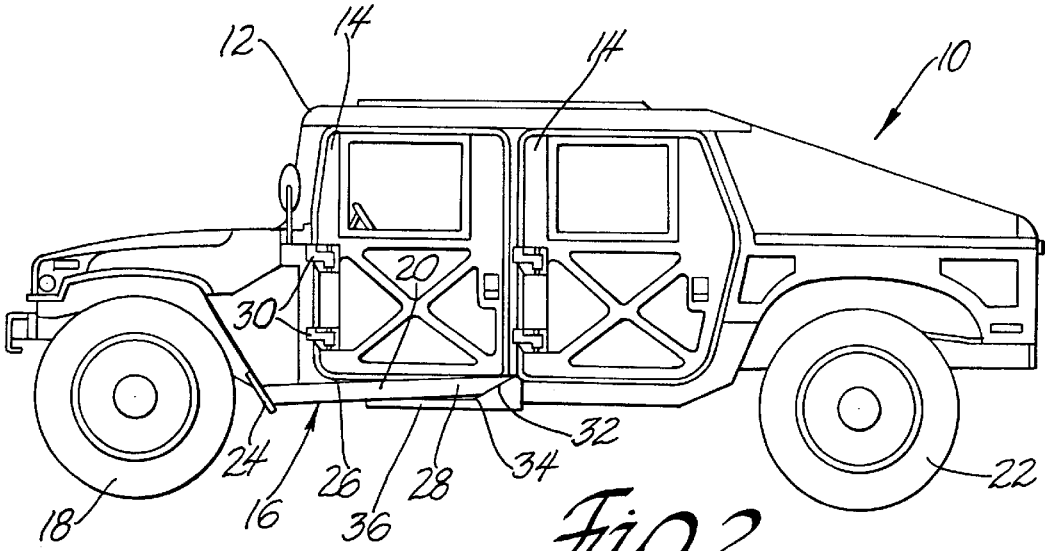
FIG. 2 is a side view of the embodiment of FIG. 1 during the a mine blast.
Figure 3:
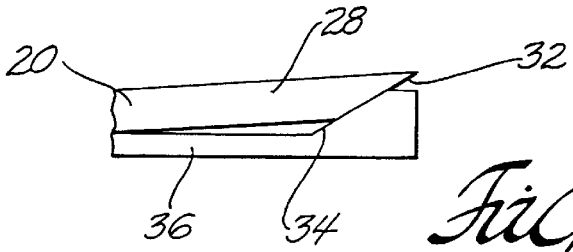
FIG. 3 is an enlarged view of a portion of FIG. 2.

Referring to the accompanying drawing in which like numerals refer to like parts and initially to FIGS. 1–3, a vehicle 10 with a cab 12 is shown with two hinged doors 14 on one side designed to permit ingress and egress from the vehicle passenger compartment. The vehicle 10 shown in FIGS. 1–3 is a high mobility wheeled vehicle designed for various light duty uses both on and off road.

The vehicle 10 has a blast shield 16 disposed across the lower forward portion of the vehicle, a majority of the shield being hidden from view. The basic structure and installation of such blast shields are known in the art and further detailed description will be omitted in the interest of brevity. The blast shield 16 is located slightly behind the foremost wheels 18 and is contoured so as to cover the underside of the front portion of cab 12 which contains the passenger-operator area of vehicle 10. The foremost portion of the blast shield 16 located nearest the front wheels 18 has an associated reactive portion shown as a reactive arm 20 attached to the blast shield which extends longitudinally along vehicle 10 towards the rear wheels 22, the reactive arm having a first end 24 mounted to the vehicle. The first end 24 of the reactive arm 20 is attached so that the deforming effect of a mine blast on the blast shield 16 will cause the reactive arm to move. In its first, normal undeployed position shown in FIG. 1, the reactive arm 20 extends parallel and juxtaposed to the lower edge 26 of door 14. The reactive arm 20 as shown in its normal, undeployed state, is also located slightly outside the plane of the outer surface of door 14 so it can move freely in a plane parallel to and slightly outside the door's outer surface. The reactive arm 20 has a second free end 28 opposite first end 24 which is free to move upwards towards the lower edge 26 of the door 14 outside the plane of the door to a blocking position where second end 28 of arm 20 prevents the door from moving on its hinges 30 to an open position.

The reactive arm 20 has a cam surface 32 on the second, free end 28 which contacts and is adapted to interact with a complimentary fixed cam surface 34 formed on a reaction plate 36 rigidly mounted on vehicle 10. The reaction plate 36 is firmly mounted to the vehicle 10 and when the reactive arm 20 moves rearward under the blast influence, will interact with the cam portion 32 of the reactive arm to move free end 28 across the swing path of door 14.

The functioning of reactive arm 20 of this embodiment in response to a blast is shown best in FIGS. 2 and 3. In these Figures, a blast (not shown) has occurred near the front wheels 18 of the vehicle 10. The blast acting rearward and upward on the shield 16 under the front portion of passenger compartment 12 has moved the reactive arm 20 towards the rear of vehicle 10 which in turn causes cam surface 32 of the reactive arm 20 to move over the mating reactive surface 34 of reaction plate 36 causing the, reactive arm to move to a point where it covers a portion of the front door 14 preventing the door from opening outward. This will protect the vehicle passengers from being ejected and the incursion of debris. This variant of the invention is particularly adapted for use where the front wheels are mounted ahead of the passenger compartment and therefore the wheels 18 will cause the detonation so the blast is in front of the passenger compartment.

Figure 4:
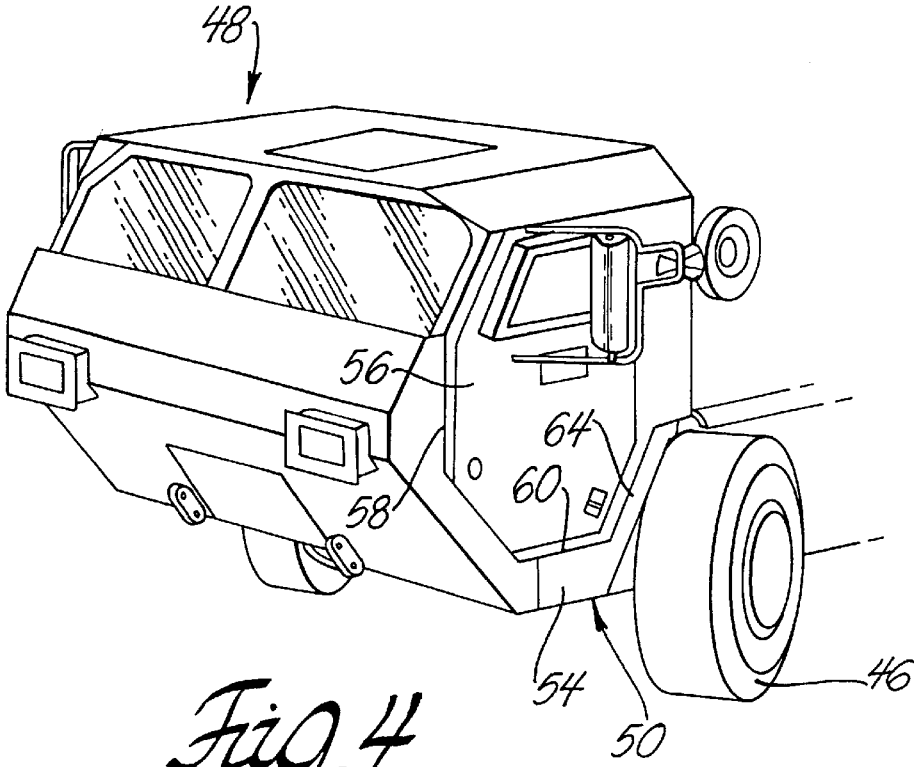
FIG. 4 is a side view of a second embodiment before a mine blast.
Figure 5:
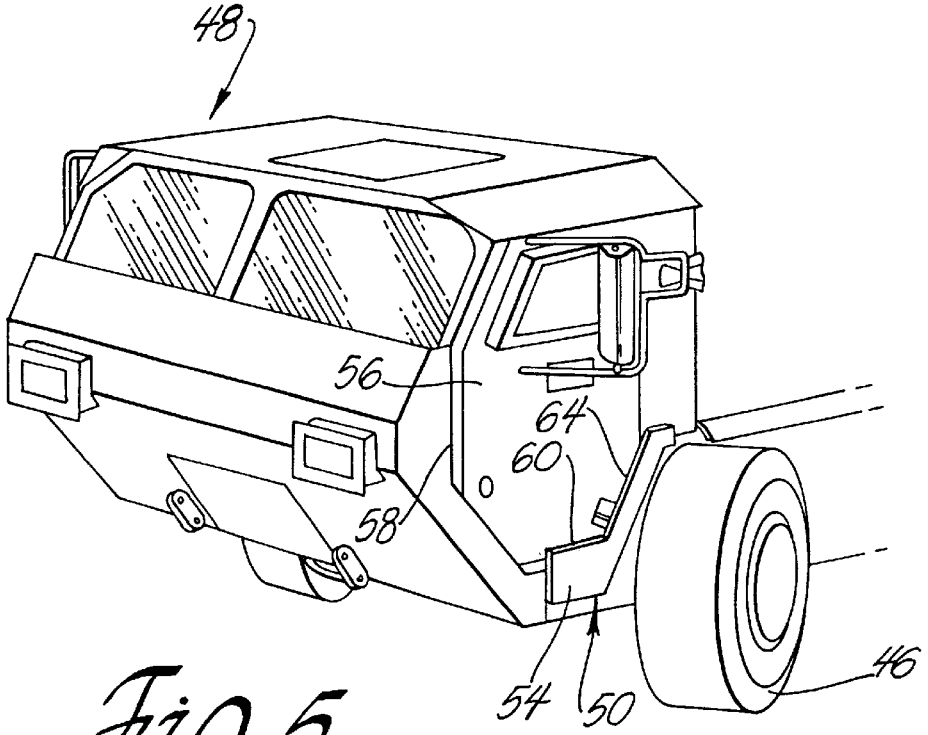
FIG. 5 is a side view of the embodiment of FIG. 4 during a mine blast.
Figure 6:
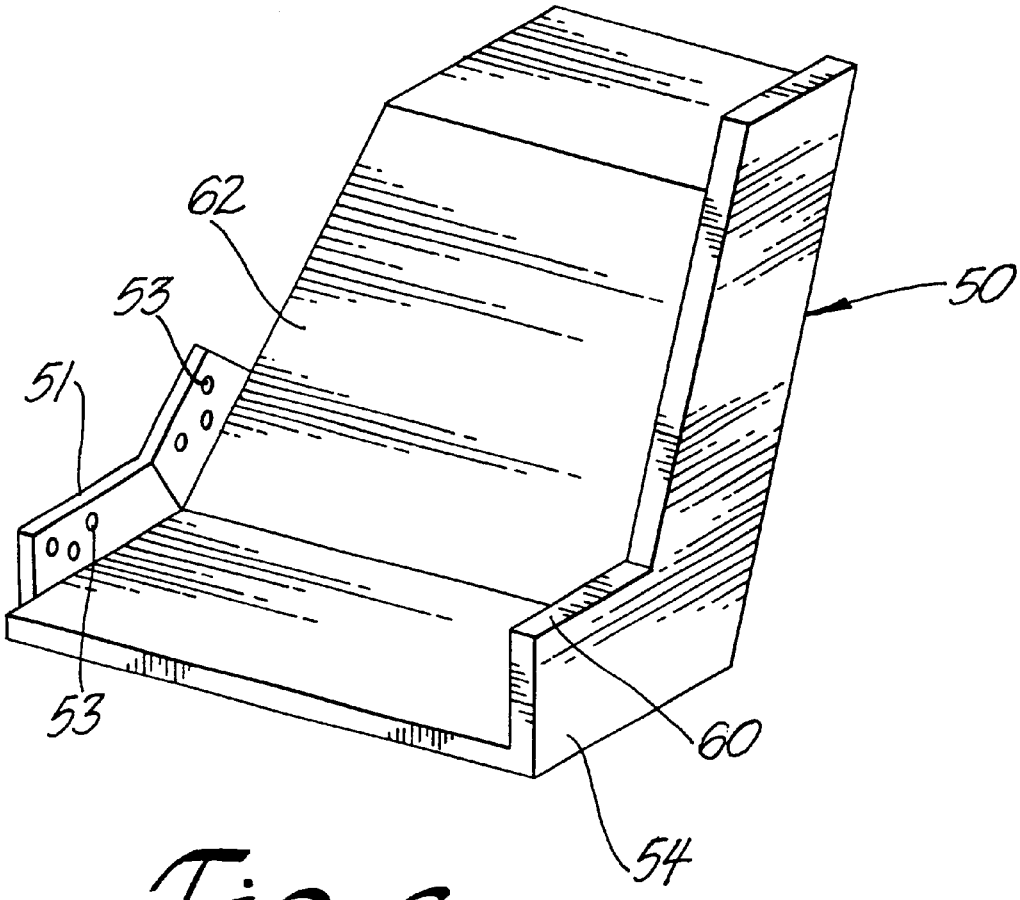
FIG. 6 is a perspective view of a partial shield of the embodiment of FIG. 4.

Certain families of military vehicles are manufactured as a cab forward design where the foremost wheels are actually located behind the passenger compartment and thus the effects of a blast will be directed to the rear portion of the passenger compartment. A second embodiment of the present invention is shown in FIGS. 4 to 6 to address this cab configuration and blast pattern. In these Figures a cab forward design is shown where there are front steering wheels 46 located physically behind a cab 48 and a mine blast acting upward is most probable near one of these front steering wheels.

In this embodiment, a blast shield 50 is formed so it extends laterally across the rear portion of cab 48. The shield 50 is attached to the truck frame (not shown) using a flange 51 and a plurality of fasteners (not shown) which pass through a plurality of apertures 53. The blast shield 50 shown has a single flange 51 but obviously multiple flanges could be used to mount the inboard side of the blast shield. The blast shield 50 as formed and mounted surrounds the lower and back portion of the cab 48 and as attached to the vehicle frame, at one edge forms a cantilevered structure. Mounting the blast shield 50 with its innermost portion attached to the vehicle frame leaves a leading free edge 54 to move or rotate about the attachment axis at the frame to a position where the free edge 54 can block the door 56 from swinging open on its hinged edge 58. As shown in FIG. 3, the blast shield 50 in its normal position forms a part of a normal construction for cab forward design. The upper edge 60 of shield 50 lies juxtaposed the lower edge of the door 56 of the cab 48. The blast shield 50 is formed with a relatively larger inclined face 62 which will receive the greater portion of any blast effect, the orientation of the face 62 receiving the blast force being inclined at an angle which causes the shield 50 to move upward and forward from its normal position. The vectors of the blast force will move at least a portion of the shield 50 to the position shown in FIG. 5. In this position, the front edge 64 has rotated and/or translated to a position where it covers a portion of the door's lower edge to forestall opening in response to a blast. Generally in using a blast shield of this structure, there will be two longitudinal beams forming a major portion of the frame. A blast shield 50 in a right and left-hand version, the left-hand version being shown in FIG. 6, will be mounted on each side of the frame with a shaped center blast resistant section disposed between the beams.

Various alterations and modifications will become apparent to those skilled in the art without departing from the scope and spirit of this invention and it is understood this invention is limited only by the following claims.

What is claimed is:

1. In a wheeled military vehicle having an occupant cab for use by personnel, the cab having at least one entrance, the entrance being closed with a door, the door being hinged on one side and secured to the cab opposite the hinges by a latching means, the cab having a ballistic blast shield, the ballistic blast shield serving to protect the cab occupants in the event of a land mine detonation, wherein the improvement comprises: forming the blast shield with a reactive arm attached, the reactive arm being juxtaposed one edge of the door and adapted to move in a plane outside the door, a cam surface attached to the vehicle and associated with the reactive arm, a mine blast acting on the blast shield causing the reactive arm to contact the cam surface moving the reactive arm from a first ready position near an edge of the door to a second blocking position where the reactive arm has moved to cover at least a portion of the door to interfere with door movement to retain the door in a closed position during the duration of the mine blast; whereby, the occupants of the cab are protected from ejection from tie vehicle for the duration of the blast effect.

2. The structure of claim 1, wherein the blast shield is responsive to the cessation of the mine blast to return the reactive arm of the blast shield to its unblocking position allowing the door to be opened for egress.

3. In a cab forward design wheeled military vehicle having an occupant cab for use by personnel, the cab being located forward of the foremost steering wheels and having at least one entrance, the entrance being closed with a door, the door being hinged on one side and secured to the cab opposite the hinges by a latching means, the cab having a ballistic blast shield, the ballistic blast shield serving to protect the cab occupants in the event of a land mine detonation, wherein the improvement comprises: attaching one end of the blast shield to a frame member located inboard of the cab, the remainder of the blast shield being supported in a cantilevered fashion with a free edge of the blast shield being juxtaposed an edge of the door, the blast shield being responsive to a mine blast acting on the blast shield the shield responding to the blast to move from a first ready position near an edge of the door to a second blocking position where the edge of the blast shield has moved to cover at least a portion of the door to interfere with door movement to retain the door in a closed position during the duration of the blast; whereby, the occupants of the cab are protected from ejection from the vehicle for the duration of the blast.

* * * * *